US009488031B2

(12) United States Patent
Leuchtenberg et al.

(10) Patent No.: US 9,488,031 B2
(45) Date of Patent: Nov. 8, 2016

(54) BLOW OUT PREVENTER

(75) Inventors: Christian Leuchtenberg, Singapore (SG); Alexander John MacGregor, Singapore (SG)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 327 days.

(21) Appl. No.: 14/006,533

(22) PCT Filed: Mar. 21, 2012

(86) PCT No.: PCT/GB2012/050615

§ 371 (c)(1),
(2), (4) Date: Oct. 23, 2013

(87) PCT Pub. No.: WO2012/127227

PCT Pub. Date: Sep. 27, 2012

(65) Prior Publication Data

US 2014/0048731 A1 Feb. 20, 2014

(30) Foreign Application Priority Data

Mar. 23, 2011 (GB) ..... 1104885.7

(51) Int. Cl.

| | |
|---|---|
| ***E21B 33/06*** | (2006.01) |
| ***E21B 33/128*** | (2006.01) |
| ***E21B 33/08*** | (2006.01) |

(Continued)

(52) U.S. Cl.

CPC ..... *E21B 33/1285* (2013.01); *E21B 21/08* (2013.01); *E21B 33/06* (2013.01); *E21B 33/085* (2013.01); *E21B 33/1208* (2013.01)

(58) Field of Classification Search

CPC ..... E21B 21/08; E21B 33/085; E21B 33/06
USPC ..... 251/1.1, 1.2, 1.3
See application file for complete search history.

(56) References Cited

U.S. PATENT DOCUMENTS

| | | | | |
|---|---|---|---|---|
| 1,861,726 A * | 6/1932 | Trout | ..... | E21B 33/06 137/112 |
| 2,155,837 A * | 4/1939 | Penick | ..... | E21B 33/06 251/1.2 |
| 2,192,805 A | 3/1940 | Seamark | | |

(Continued)

FOREIGN PATENT DOCUMENTS

| | | |
|---|---|---|
| EP | 1 061 231 A2 | 12/2000 |
| EP | 1 659 260 A2 | 5/2006 |

(Continued)

*Primary Examiner* — Craig Schneider
*Assistant Examiner* — Andrew J Rost
(74) *Attorney, Agent, or Firm* — Norman B. Thot

(57) ABSTRACT

A blow out preventer (BOP) for use in the drilling of a wellbore into a subterranean fluid reservoir and/or the production of fluid is provided. The BOP includes a housing having longitudinal axis and being divided into a first housing part and a second housing part, movement of the first housing part relative to the second housing part being prevented by fasteners, each fastener including a shaft which extends through a fastener receiving passage provided in the first housing part into a fastener receiving passage provided in the second housing part. The housing is further provided with fluid flow passages which extend from the first part of the housing to the second part of the housing, the fluid flow passages being interspersed between fastener receiving passages.

32 Claims, 5 Drawing Sheets

Figure 1:
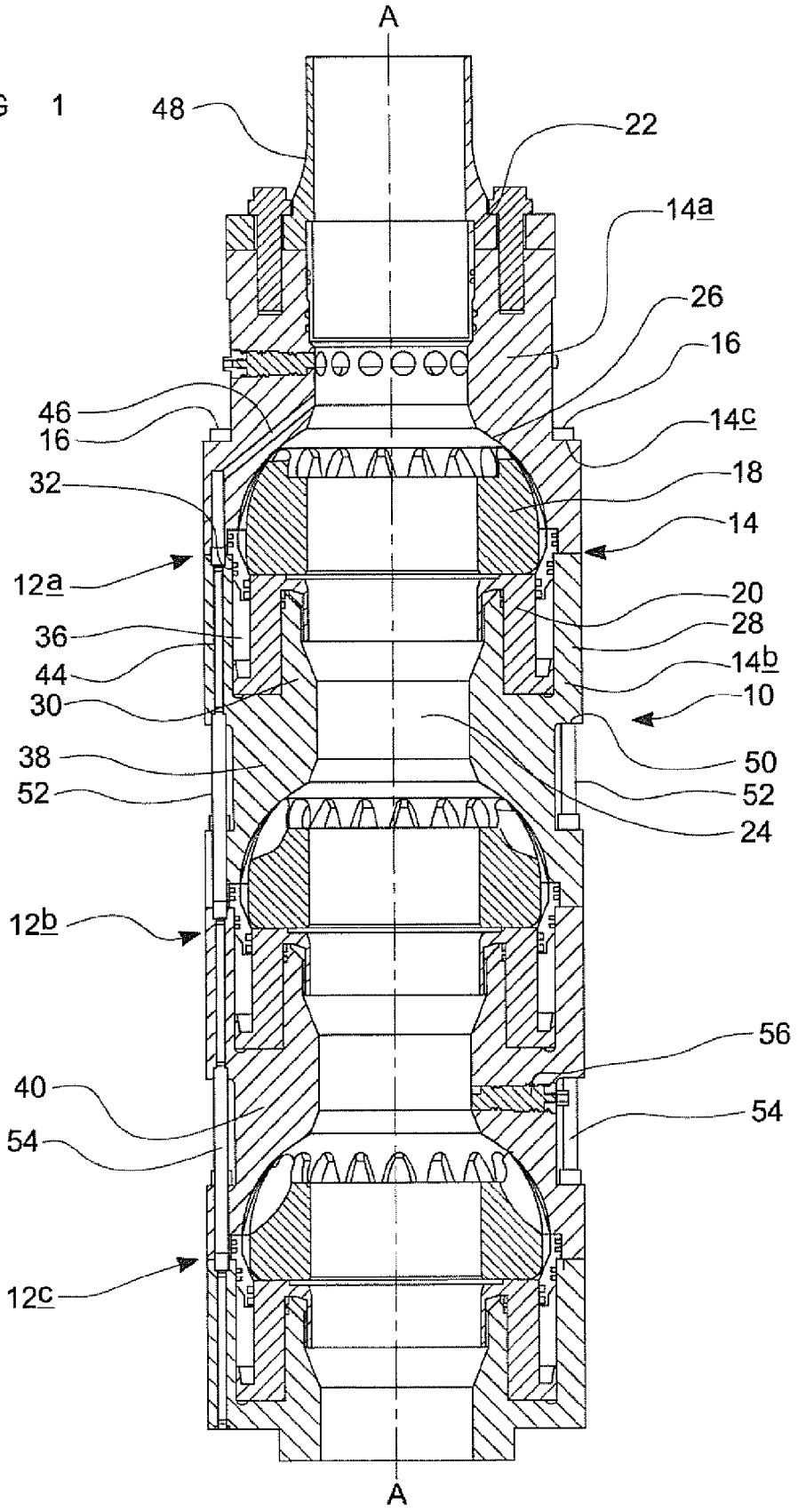

(51) Int. Cl.
*E21B 21/08* (2006.01)
*E21B 33/12* (2006.01)

(56) References Cited

U.S. PATENT DOCUMENTS

| | | | | |
|---|---|---|---|---|
| 2,609,836 | A | 9/1952 | Knox | |
| 2,731,281 | A | 1/1956 | Knox | |
| 2,904,357 | A | 9/1959 | Knox | |
| 3,168,320 | A | 2/1965 | Sneed | |
| 3,225,831 | A | 12/1965 | Knox | |
| 3,561,723 | A | 2/1971 | Cugini | |
| 3,614,111 | A | 10/1971 | Regan | |
| 3,651,823 | A | 3/1972 | Milsted, Sr. | |
| 3,667,721 | A * | 6/1972 | Vujasinovic | E21B 33/06 251/1.1 |
| 3,827,487 | A | 8/1974 | Jackson et al. | |
| 3,871,665 | A | 3/1975 | Burke et al. | |
| 4,098,341 | A | 7/1978 | Lewis | |
| 4,358,085 | A | 11/1982 | Regan et al. | |
| 4,509,405 | A | 4/1985 | Bates | |
| 4,626,135 | A | 12/1986 | Roche | |
| 4,832,126 | A | 5/1989 | Roche | |
| 4,949,785 | A | 8/1990 | Beard et al. | |
| 5,074,518 | A | 12/1991 | Berry | |
| 5,080,174 | A | 1/1992 | Hynes | |
| 5,100,950 | A | 3/1992 | Carlson et al. | |
| 5,178,215 | A | 1/1993 | Yenulis et al. | |
| 5,224,557 | A | 7/1993 | Yenulis et al. | |
| 5,273,108 | A * | 12/1993 | Piper | E21B 33/06 166/90.1 |
| 5,361,832 | A | 11/1994 | Van Winkle | |
| 6,109,348 | A | 8/2000 | Caraway | |
| 6,129,152 | A | 10/2000 | Hosie et al. | |
| 6,192,680 | B1 | 2/2001 | Brugman et al. | |
| 6,554,016 | B2 | 4/2003 | Kinder | |
| RE38,249 | E | 9/2003 | Tasson et al. | |
| 6,749,172 | B2 | 6/2004 | Kinder | |
| 6,896,076 | B2 | 5/2005 | Nelson et al. | |
| 7,004,444 | B2 | 2/2006 | Kinder | |
| 7,007,913 | B2 | 3/2006 | Kinder | |
| 7,040,374 | B2 | 5/2006 | Wen et al. | |
| 7,380,590 | B2 | 6/2008 | Hughes et al. | |
| 7,559,359 | B2 * | 7/2009 | Williams | E21B 33/085 166/84.3 |
| 7,699,109 | B2 | 4/2010 | May et al. | |
| 7,926,560 | B2 | 4/2011 | Bailey et al. | |
| 2002/0100589 | A1 | 8/2002 | Childers et al. | |
| 2004/0113108 | A1 | 6/2004 | Ward | |
| 2008/0302536 | A1 | 12/2008 | Kotrla et al. | |
| 2009/0161997 | A1 | 6/2009 | Beauchamp et al. | |
| 2011/0005770 | A1 | 1/2011 | Scranton et al. | |
| 2011/0024195 | A1 | 2/2011 | Hoyer et al. | |
| 2011/0088913 | A1 | 4/2011 | Baugh | |
| 2011/0100637 | A1 | 5/2011 | Gustafson | |
| 2011/0131964 | A1 | 6/2011 | Kocurek et al. | |

FOREIGN PATENT DOCUMENTS

| | | | |
|---|---|---|---|
| GB | 326615 | A | 3/1930 |
| GB | 627196 | A | 8/1949 |
| GB | 1 294 288 | A | 10/1972 |
| RU | 2 198 282 | C2 | 5/2002 |
| WO | WO 98/07956 | A1 | 2/1998 |
| WO | WO 2008/024265 | A2 | 2/2008 |
| WO | WO 2009/017418 | A1 | 2/2009 |
| WO | WO 2009/021037 | A2 | 2/2009 |
| WO | WO 2009/132300 | A2 | 10/2009 |
| WO | WO 2011/128690 | A1 | 10/2011 |

* cited by examiner

BLOW OUT PREVENTER

The present invention relates to a blow out preventer (BOP) for use in the drilling of a wellbore into a subterranean fluid reservoir and/or the production of fluid, typically hydrocarbon fluids, from such a reservoir.

The drilling of a borehole or well is typically carried out using a steel pipe known as a drill pipe or drill string with a drill bit on the lowermost end. The drill string comprises a series of tubular sections, which are connected end to end. The entire drill string is typically rotated using a rotary table mounted on top of the drill pipe, and as drilling progresses, a flow of mud is used to carry the debris created by the drilling process out of the wellbore. Mud is pumped down the drill string to pass through the drill bit, and returns to the surface via the annular space between the outer diameter of the drill string and the wellbore (generally referred to as the annulus). For a subsea well bore, a tubular, known as a riser, extends from the rig to the top of the wellbore and provides a continuous pathway for the drill string and the fluids emanating from the well bore. In effect, the riser extends the wellbore from the sea bed to the rig, and the annulus also comprises the annular space between the outer diameter of the drill string and the riser.

The use of blow out preventers to seal, control and monitor oil and gas wells is well known, and these are used on both land and off-shore rigs. During drilling of a typical high-pressure wellbore, the drill string is routed through a BOP stack toward a reservoir of oil and/or gas. The BOP is operable to seal around the drill string, thus closing the annulus and stopping flow of fluid from the wellbore. The BOP stack may also be operable to sever the drill string to close the wellbore completely. Two types of BOP are in common use—ram and annular, and a BOP stack typically includes at least one of each type.

Whilst land and subsea BOPs are generally secured to a well head at the top of a wellbore, BOPs on off-shore rigs are generally mounted below the rig deck in the riser. To install a BOP in the riser, it is desirable to run the BOP through the central aperture in the rotary table, but the outer diameter of conventional BOPs is generally too great for this to be possible.

The present invention relates to a new configuration of BOP which may have a smaller outer diameter for a given operating force than conventional BOPs.

According to a first aspect of the invention we provide a blow out preventer comprising a housing which has a longitudinal axis and which is divided in a first housing part and a second housing part, movement of the first housing part relative to the second housing part being prevented by fasteners, each fastener including a shaft which extends through a fastener receiving passage provided in the first housing part into a fastener receiving passage provided in the second housing part, the housing being further provided with fluid flow passages which extend from the first part of the housing to the second part of the housing, the fluid flow passages being interspersed between fastener receiving passages.

By virtue of this arrangement, the outer diameter of the blow out preventer may be reduced.

Preferably the outer diameter of the blow-out preventer is less than 47 inches (119.4 cm).

In a preferred embodiment of the invention, the fluid flow passages and the fastener receiving passages are arranged in a generally circular array. In this case, preferably the circular array is centred around the longitudinal axis of the blow out preventer.

In one embodiment of the invention, there are two or more fastener receiving passages between each adjacent pair of fluid flow passages.

The fasteners preferably comprise a shaft which, in use, extends into one of the fastener receiving passages, at least a portion of which is threaded, and at least a portion of the fastener receiving passage in one or both of the first of second part of the housing is provided with a correspondingly threaded portion so that, in use, the threaded portion of the shaft of each fastener is engaged with the threaded portion of fastener receiving passage.

The fastener receiving passages preferably extend from a shoulder in the exterior surface of the housing which joins a smaller outer diameter portion of housing with a larger outer diameter portion of housing, into the housing. In one embodiment of the invention, the shoulder extends generally perpendicular to the longitudinal axis of the blow out preventer. The fasteners may each be provided with a head at one end of the shaft, when in use, the head engaging with the shoulder.

The fastener receiving passages and the fluid flow passages may extend generally parallel to the longitudinal axis of the blow out preventer.

A sealing device is advantageously provided between the first part of the housing and the second part of the housing. In one embodiment of the invention, the sealing device engages with the interior surface of both the first part of the housing and the second part of the housing.

The blow out preventer may further comprise an annular packing element and an actuating part which is movable generally parallel to the longitudinal axis of the blow out preventer to push the packing element into engagement with the first part of the housing, compression of the packer element against the first part of the housing causing the diameter of the space enclosed by the packing element to decrease. In this case, preferably the internal diameter of the first part of the housing increases from a first port to a second port so that the interior face of the first part of the housing forms a cam surface with which the packing element engages when compressed by the actuating part.

The blow out preventer may further including a fluid pressure actuated locking part which is provided in an aperture extending from the exterior of the housing to the interior of the housing, and which is movable from a retracted position in which the locking part does not extend into the interior of the housing to a locking position in which the locking part extends into the interior of the housing.

According to a second aspect of the invention we provide a blow out preventer stack comprising a plurality of blow out preventers in accordance with the first aspect of the invention, the blow out preventer being arranged such that the longitudinal axis of each lies on a single line.

In one embodiment of blow out preventer stack, the first part of the housing of a first blow out preventer is integrally formed with the second part of the housing of a second blow out preventer. In this case, the exterior of the housing is provided with a shoulder which joins the smaller diameter portion of the first part of the housing of the first blow out preventer with the second part of the housing of the second blow out preventer, the second part having a smaller external diameter than the first part.

In one embodiment of the invention, at least one of the fluid flow passages in the housing of the first blow out preventer is connected to a fluid flow passage in the housing of the second blow out preventer via a pipe at least a portion of which is external to the housing. In this case, the pipe may extend from a shoulder between the second part of the housing of the second blow out preventer and a smaller outer diameter portion of the first part of the housing of the first blow out preventer and a shoulder between the smaller outer diameter portion and a larger outer diameter portion of the first part of the housing of the first blow out preventer.

According to a third aspect of the invention we provide a blow out preventer stack comprising three annular blow out preventers coaxially arranged around the longitudinal axis of the blow out preventer stack. Each blow out preventer may comprise a housing having a first part and a second part, an annular packing element and an actuating part which is movable generally parallel to the longitudinal axis of the blow out preventer to push the packing element into engagement with the first part of the housing, compression of the packing element against the first part of the housing causing the diameter of the space enclosed by the packing element to decrease.

In this case, the internal diameter of the first part of the housing increases from a first port to a second port so that the interior face of the first part of the housing forms a cam surface with which the packing element engages when compressed by the actuating part.

At least one of the blow out preventers in the blow out preventer stack may have any of the features of the blow out preventer according to the first aspect of the invention.

According to a fourth aspect of the invention we provide a blow out preventer comprising a housing, and a fluid pressure actuated locking part which is provided in an aperture extending from the exterior of the housing to the interior of the housing, and which is movable from a retracted position in which the locking part does not extend into the interior of the housing to a locking position in which the locking part extends into the interior of the housing.

Two fluid pressure operated locking parts may be provided, the two fluid pressure operated locking parts being separated longitudinally relative to the housing.

The blow out preventer may also include any of the features of the blow out preventer according to the first aspect of the invention.

According to a fifth aspect of the invention we provide a blow out preventer assembly including the blow out preventer according to the third aspect of the invention and a tubular component which is located in a central passage of the blow out preventer housing, the locking part when in its locking position, engaging with the tubular component to prevent or restrict translational movement of the tubular component along the central passage of the blow out preventer housing.

The blow out preventer may include first and second fluid pressure operated locking parts, the two fluid pressure operated locking parts being separated longitudinally relative to the housing, the first locking part when in its locking position, engaging with the tubular component to prevent or restrict translational movement of the tubular component in a first direction along the central passage of the blow out preventer housing, and the second locking part, when in its locking position, engaging with the tubular component to prevent or restrict translational movement of the tubular component in a second direction along the central passage of the blow out preventer housing.

Figure 2:
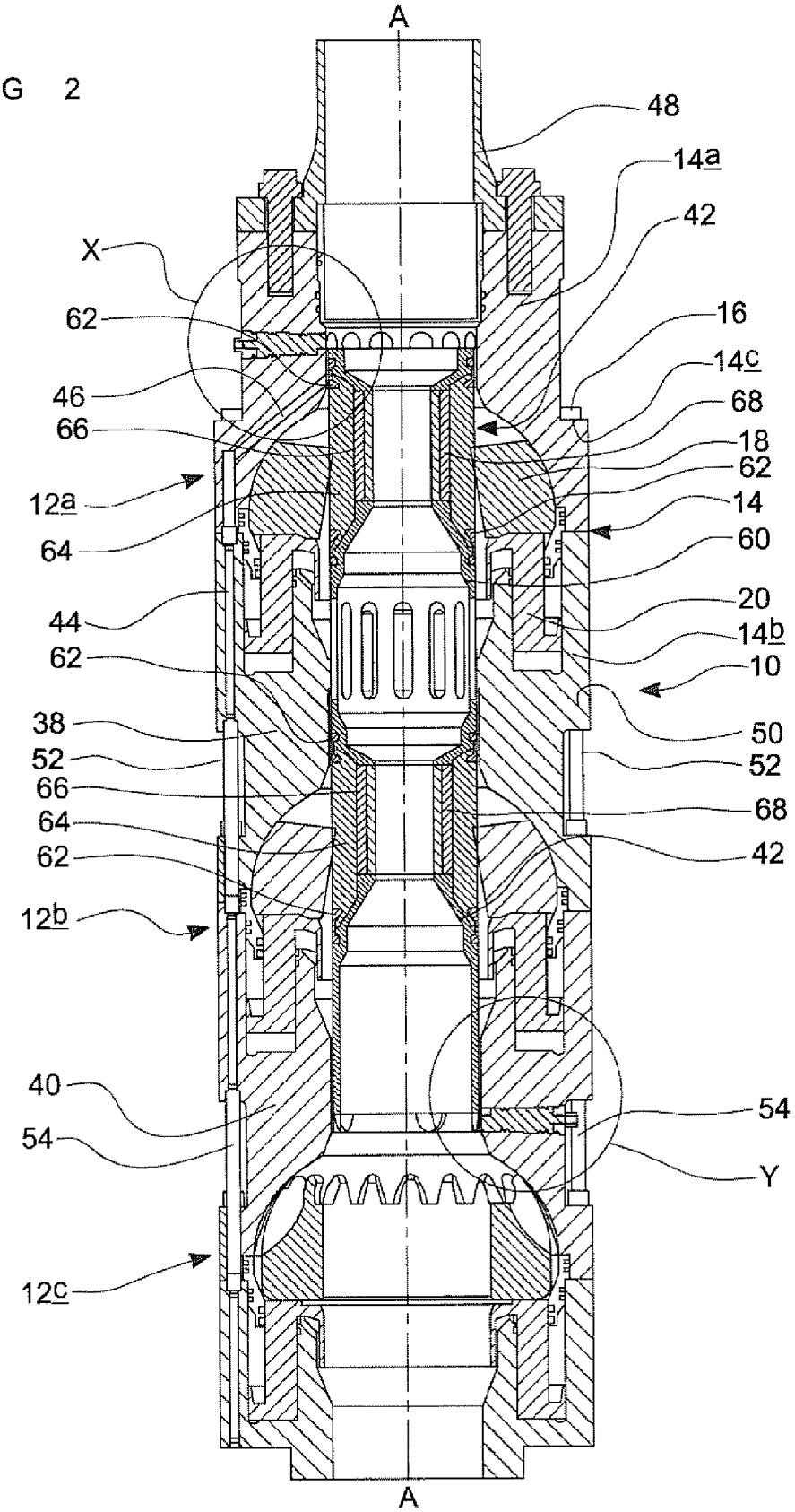
Figure 3:
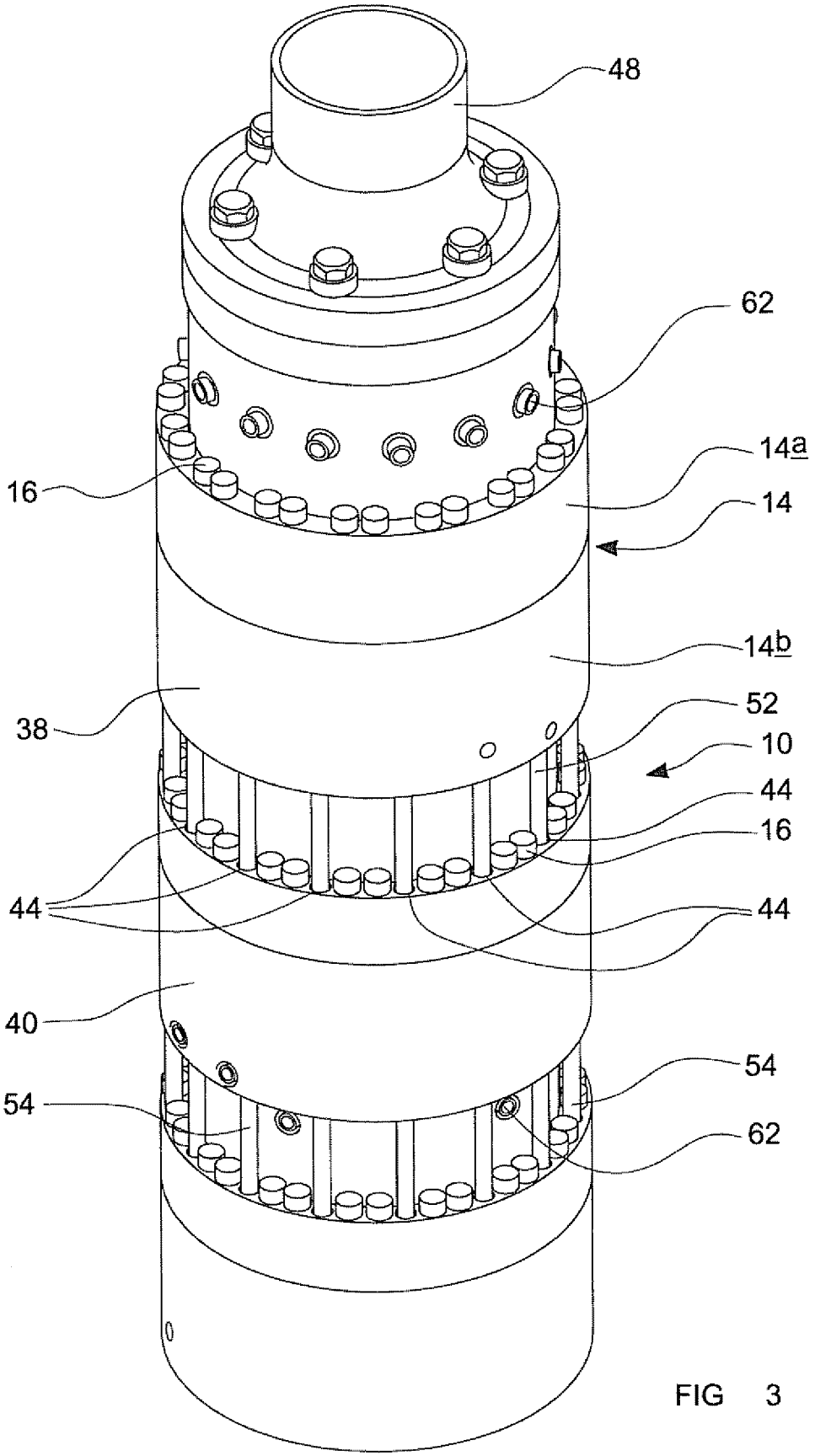
Figure 4:
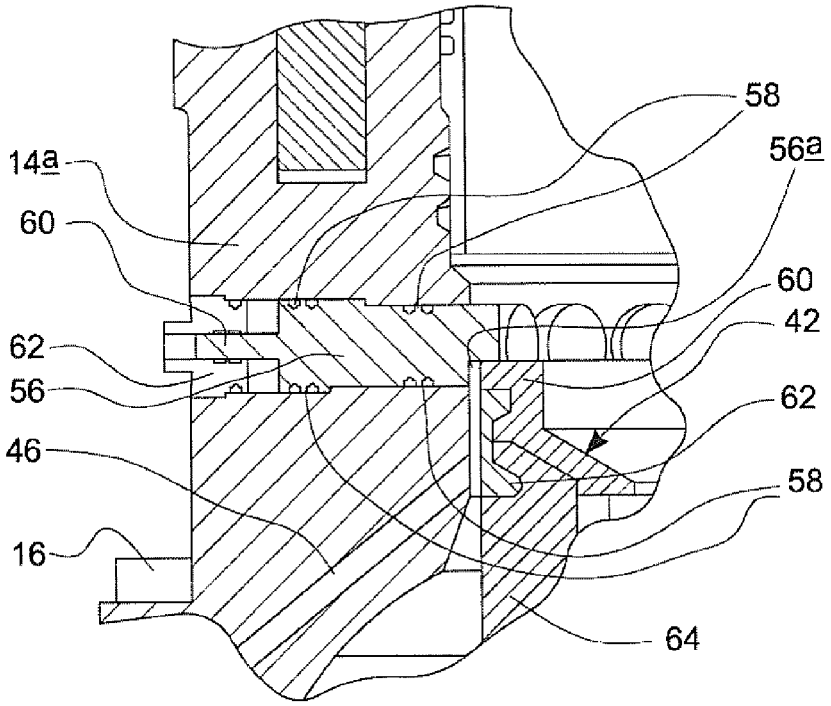
Figure 5:
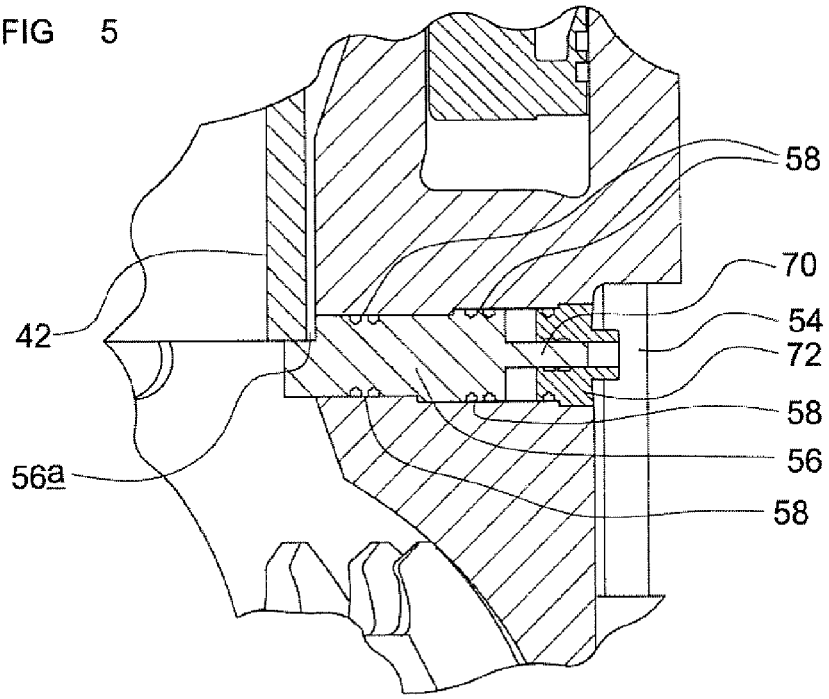
Figure 6:
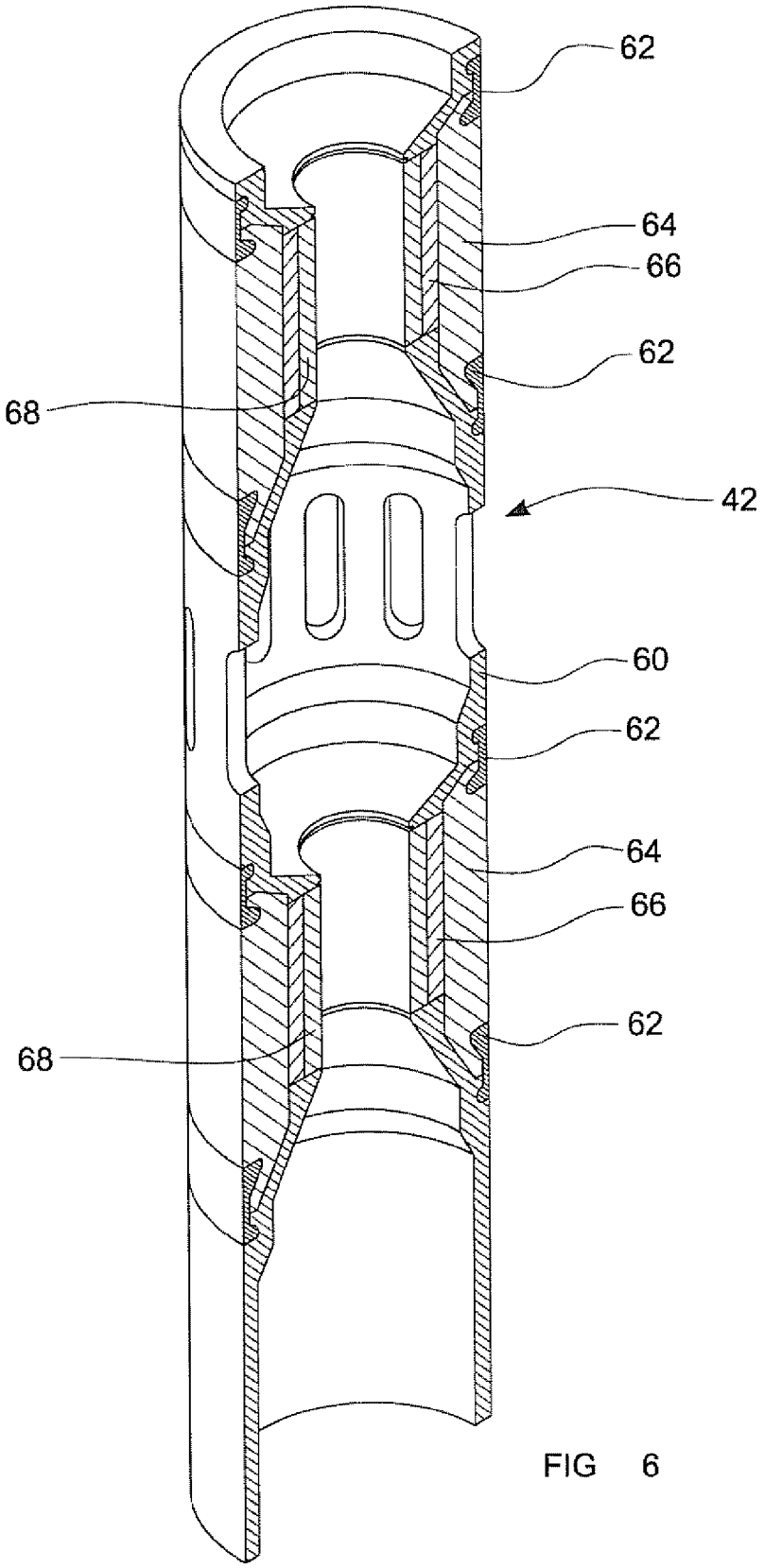

An embodiment of the invention will now be described, by way of example only, with reference to the accompanying drawings, of which FIG. 1 is a longitudinal cross-section through a BOP stack including three BOPs in accordance with the invention, FIG. 2 is a longitudinal cross-section through the BOP stack shown in FIG. 1 with a seal assembly positioned in the BOP stack, FIG. 3 is a perspective side view of the BOP stack illustrated in FIG. 1, FIG. 4 is a detailed view of the portion of the cross-section through the BOP stack marked X in FIG. 1, FIG. 5 is a detailed view of a cross-section through one of the lower locking dogs in the BOP stack illustrated in FIG. 1, FIG. 6 is a perspective illustration of the longitudinal cross-section through the seal assembly shown in FIG. 2.

Referring now to FIG. 1, there is shown a BOP stack 10 which, in this example comprises three BOPs 12*a*, 12*b*, 12*c* in accordance with the invention. In this example, each of the BOPs is an annular BOP, the internal working parts of which are based on the original Shaffer annular BOP design set out in U.S. Pat. No. 2,609,836. It should be appreciated, however, that the invention does not reside in the internal working parts of the BOP, and therefore may be applied to any other design of BOP. It should also be appreciated that in this example, each BOP 12*a*, 12*b*, 12*c* in the stack is substantially identical to the others, and, for clarity the reference numerals used in the description below have been shown in the accompanying figures only in relation to the uppermost BOP 12*a* in the stack 10. The same parts, are, however, included in each of the BOPs 12*a*, 12*b*, 12*c*. The BOPs 12*a*, 12*b*, 12*c* need not all be of the same configuration, of course, and the BOP stack 10 could include more than or fewer than three BOPs.

Each BOP 12*a*, 12*b*, 12*c* comprises a housing 14 which is divided into a first part 14*a* and a second part 14*b* which are fastened together using a plurality of fasteners 16. Whilst a convention stud and nut connection could be used, in this example, large cap head screws or bolts are used. The exterior surface of each housing part 14*a*, 14*b* is generally cylindrical, as illustrated best in FIG. 3. The first housing part 14*a* is, however, provided with a shoulder 14*c* which extends generally perpendicular to the longitudinal axis A of the BOP 12*a*, 12*b*, 12*c* between a smaller outer diameter portion and a larger outer diameter portion, the larger outer diameter portion being between the smaller outer diameter portion and the second part 14*b* of the housing 14. The outer diameter of the second part 14*b* of the housing 14 is approximately the same as the outer diameter of the larger outer diameter portion of the first part 14*a* of the housing 14.

A plurality of generally cylindrical fastener receiving passages ("bolt holes") are provided in the housing 14, and in this embodiment of the invention, these extend generally parallel to the longitudinal axis A of the BOP 12*a* from the shoulder 14*c* through the larger outer diameter portion of the first part 14*a* of the housing 14 into the outer wall 28 of the second part 14*b* of the housing 14. Preferably the portion of each bolt hole in the second part 14*b* of the housing 14 is threaded, so that the two parts 14*a*, 14*b* of the housing 14 may be secured together by passing a bolt 16 through each of these bolt holes so that a threaded shank of each bolt 16 engages with the threaded portion of the bolt hole whilst a head of the bolt 16 engages with the shoulder 14*c*.

In order to ensure that the housing 14 is substantially fluid tight, in a preferred embodiment of the invention, a sealing device is provided between the first part 14*a* and the second part 14*b* of the housing 14. This sealing device may comprise an O-ring or the like located between the adjacent end faces of the two parts 14*a*, 14*b* of the housing 14, the end faces extending generally perpendicular to the longitudinal axis of the BOP 12*a*. This means that the sealing device is crushed between the two parts 14*a*, 14*b* of the housing 14 as the bolts 16 are tightened. This could result in damage to the sealing device. As such, in the preferred embodiment of the invention, illustrated in FIGS. 1 and 2, the sealing device comprises a sealing ring 32 which engages with the interior face of the housing 14, extending between the first and second parts 14*a*, 14*b*. By locating the seal device in this position, the sealing device is not subjected to loading from the bolts 16 as the bolts 16 are tightened.

In addition to the bolt holes, there are further passages (fluid flow passages) which extend generally parallel to the longitudinal axis A of the BOP 12*a* through one or both of the larger outer diameter portion of the first part 14*a* of the housing 14 and the outer wall 28 of the second part 14*b* of the housing 14. These passages provide conduits for directing fluids, such as lubricant or drilling mud scavenging fluid to selected positions within the housing 14. One such fluid flow passage 44 is illustrated in FIGS. 1 and 2, and the upper end of the passage 44 within the larger outer diameter portion of the first housing part 14*a* is connected to the interior of the housing 14 above the annular packing element 18 by a further, diagonally extending passage 46. In order to accommodate the fluid flow passages 44 and the bolt holes in the housing 14 whilst minimising the outer diameter of the BOP 12*a*, the fluid flow passages are interspersed between the bolt holes. In this embodiment of the invention, the fluid flow passages and bolt holes lie in a generally circular array around the housing 14 with the longitudinal axes of each being substantially equidistant from the longitudinal axis A of the BOP stack 10.

In the embodiment of the invention shown in the Figures, there are forty five longitudinal passages extending through the housing 14 as described above—thirty are bolt holes, and fifteen are fluid flow passages 44. These are arranged so that there are always two directly adjacent bolt holes, each pair of bolt holes being separated by a hydraulic passage 44. This is best illustrated in FIG. 3.

In another embodiment of the invention, there are forty eight longitudinal passages—thirty six bolt holes and twelve fluid flow passages, again arranged in a generally circular array centred around the longitudinal axis A of the BOP stack 10. In this embodiment, preferably there are three bolt holes between adjacent fluid flow passages. Whilst in the embodiment of the invention shown in the figures, the longitudinal axes of the bolt holes and fluid flow passages 44 are generally evenly spaced around the housing 14, this need not be the case. It may be desirable to provide more space around each bolt hole, for example to accommodate the head of the fastener being place in the bolt hole and/or to provide sufficient room for a tool to be used to tighten the fasteners. It may also be desirable to increase the diameter of each bolt hole relative to the fluid flow passages 44 so as to accommodate larger diameter bolts.

An annular packing element 18 is housed in the first part 14*a* of the housing 14, and a hydraulic actuating piston 20 is housed in the second part 14*b* of housing 14. Circular axial ports 22, 24 are provided in the first 14*a* and second 14*b* parts of the housing 14 respectively, the first part 14*a* of the housing 14 including an enlarged cylindrical bore 26 which includes a curved, preferably hemispherical, cam surface which extends from the port 22 to the second part 14*b* of the housing 14.

The second part 14*b* of the housing 14 includes a generally cylindrical outer wall 28, and a generally coaxial, cylindrical inner wall 30, connected by a base part 31. The piston 20 is located in the annular space between the outer wall 28 and the inner wall 30, sealing devices (such as one or more O-rings) are provided between the piston 20 and each of the outer wall 28 and inner wall 30 so that the piston 20 divides this annular space into two chambers, and prevents any substantial leakage of fluid round the piston 20 from one chamber to the other.

In this example, the piston 20 has a generally cylindrical body 20*a* which engages with or is very close to the inner wall 30 but which is spaced from the outer wall 28. At a lowermost end of the piston 20 (the end which is furthest from the packing element 18), there is provided a sealing part 20*b* which extends between the outer wall 28 and the inner wall 30, there being sealing devices between the sealing part 20*b* and both the outer wall 28 and inner wall 30. The sealing ring 32 is also in sealing engagement with the uppermost end of the piston 20 (the end which is closest to the packing element 18). A first fluid tight chamber 34 is therefore formed between the outer wall 28, inner wall 30, base part 31 and the sealing part 20*b* of the piston 20*b*, and a second fluid tight chamber 36 is formed between the outer wall 28, the sealing device 32 and the sealing part 20*b* and the body 20*a* of the piston 20.

The piston 20 is movable between a rest position in which the volume of the first chamber 34 is minimum, and an active position in which the uppermost end of the piston 20 extends into the first part 14*a* of the housing 14.

A first control passage (not shown) is provided through the second part 14*b* of the housing 14 to connect the first chamber 34 with the exterior of the housing 14, and a second control passage (not shown) is provided through the second part 14*b* of the housing 14 to connect the second chamber 36 with the exterior of the housing 14. The piston 20 may thus be moved to the active position towards the packing element 18 by the supply of pressurised fluid through the first passage, and to the rest position away from the packing element 18 by the supply of pressurised fluid through the second passage. Advantageously, at least a substantial portion of each of these control passages is one of the fluid flow passages described above.

The piston 18 is arranged such that when it is in the rest position, it does not exert any forces on the packing element 18, whereas when it is in the active position, it pushes the packing element 18 against the cam surface. The packing element 18 is made from an elastomeric material, typically a rubber, and may include metallic inserts or ribs to assist in maintaining its structural integrity. The action of the piston 20 forcing it against the cam surface causes the packing element 18 to be compressed, and to constrict, like a sphincter, reducing the diameter of its central aperture.

In this example, the BOP stack 10 comprises three BOPs 12*a*, 12*b*, 12*c*, which are co-axially aligned about a single longitudinal axis A. The second part 14*b* of the housing 14 of the top BOP 12*a* is integrally formed with the first part of the housing of the middle BOP 12*b* (thus forming a first combined housing part 38), and the second part of the housing of the middle BOP 12*b* is integrally formed with the first part of the housing of the bottom BOP 12*c* (thus forming a second combined housing part 40). The housings of each BOP 12*a*, 12*b*, 12*c* thus form a continuous central passage which extends along the longitudinal axis A of the BOP stack 10. In use, the BOP stack 10 may be mounted in a riser with the first part 14*a* of the housing 14 of the uppermost BOP 12*a* being secured, by conventional means, to an upper portion of riser 48, and the second part 14*b* of the housing of the lowermost BOP 12*c* being secured, by conventional means, to a lower portion of riser (not shown).

It should be appreciated that this integration of housing parts means that there are two shoulders in the exterior surface of the combined housing part 38, 40, the first of which extends generally perpendicular to the longitudinal axis A of the BOP stack 10 between the second part 14*b* of the upper BOP 12*a*, 12*b* and the smaller diameter portion of the first part 14*a* of the lower BOP 12*b*, 12*c*, and the second of which extends generally perpendicular to the longitudinal axis A of the BOP stack 10 between the smaller diameter portion and the larger diameter portion of the first part 14*a* of the lower BOP 12*b*, 12*c*.

The bolt holes for connecting the first combined housing part 38 to the second combined housing part 40 extend from the second shoulder in the first combined housing part 38 and into the outer wall of the second housing part of the middle BOP 12*b*. The bolt holes for connecting the second combined housing part 40 to the second housing part of the lowermost BOP 12*c* extend from the second shoulder in the second combined housing part 40 and into the outer wall of the second housing part of the lowermost BOP 12*c*. The heads of the bolts 16 thus engage with the second shoulder on each of the combined housing parts 38, 40.

In order to extend the hydraulic passages 44 along the entire length of the BOP stack 10, hydraulic connector pipes 52 are provided. Each hydraulic passage 44 in the housing 14 of the uppermost BOP 12*a* extends through to the first shoulder of the first combined housing part 28 where it joins a first hydraulic connector pipe 52. The first hydraulic connector pipe 52 extends through the hydraulic passage provided in the first part of the housing of the middle BOP 12*b* where it connects with a hydraulic passage in the second part of the housing of the middle BOP 12*b*. The hydraulic passage then emerges at the first shoulder of the second combined housing part 40 where it joins with a second hydraulic connector pipe 54. The second hydraulic connector pipe 54 extends through the hydraulic passage provided in the first part of the housing of the lowermost BOP 12*c* where it connects with a hydraulic passage in the second part of the housing of the lowermost BOP 12*c*. The hydraulic passage then emerges from the lowermost transverse face of the housing 14 of the lowermost BOP 12.

All external hydraulic connections to the interior of the BOP stack 10 may thus be made via the lowermost transverse face of the BOP stack 10, thus ensuring that the hydraulic connections need not increase the outer diameter of the BOP stack 10.

The hydraulic connector pipes 52 are sealed to the housing 14 by means of stingers including seals such as O-rings, and are held captive once the BOP stack is assembled. To achieve this, each first hydraulic connector pipe 52 is inserted through the hydraulic passage in the first part of the housing of the middle BOP 12*b* and brought into sealing engagement with the hydraulic passage in the second part 14*b* of the housing 14 of the uppermost BOP 12*a* at the first shoulder 50 in the first combined housing part 38. The first combined housing part 38 may then be bolted to the second combined housing part 40. Similarly, each second hydraulic connector pipe 54 is inserted through the hydraulic passage in the first part of the housing of the lowermost BOP 12*b* and brought into sealing engagement with the hydraulic passage in the second part of the housing of the middle BOP 12*b* at the first shoulder 50 in the second combined housing part 40. The second combined housing part 40 may then be bolted to the second housing part of the lowermost BOP 12*c*.

Referring now to FIG. 2, this shows the BOP stack 10 with a seal assembly 42 located in the central passage of the BOP stack 10. The seal assembly 42 is shown in detail in FIG. 6 and comprises a support framework 60, which is formed in three parts which are, in a preferred embodiment of the invention, fabricated from a steel. The first part 60*a* is uppermost when the seal assembly 42 is in use, mounted in the BOP stack 10 as shown in FIG. 2, and comprises an annular collar with a lip extended radially inwardly from the lowermost end of the collar, the lip being inclined towards the lowermost end of the sealing assembly at an angle of around 45° to the longitudinal axis A of the BOP stack 10. The inclined lip has at its radially inward edge an edge portion with a surface which lies in a plane generally normal to the longitudinal axis A of the BOP stack 10 and which faces the second part 60*b* of the support frame 60.

The second part 60*b* is below the first part 60*a* and comprises a tubular wall with a generally circular cross-section, having at both its uppermost and lowermost ends a radially inwardly extending lip. Both lips are inclined at an angle of around 45° to the longitudinal axis A of the BOP stack 10 away from the tubular wall. The uppermost lip is therefore inclined towards the first part 60*a* of the support frame, whilst the lowermost lip is inclined towards a third, lowermost, part 60*c* of the support frame 60. The inclined lips at the uppermost and lowermost ends of the second part 60*b* have at their radially inward edge an edge portion with a surface which lies in a plane generally normal to the longitudinal axis A of the BOP stack 10 and which face the first part 60*b* of the support frame 60, and the third part 60*c* of the support frame 60 respectively.

The lowermost part 60*c* of the support frame 60 also comprises a tubular wall which a generally circular transverse cross-section, with a radially inwardly extending lip at its uppermost end. The lip is also inclined at around 45° to the longitudinal axis A of the BOP stack 10 away from the tubular wall and towards the second part 60*b* of the support frame 60. The inclined lip also has at its radially inward edge an edge portion with a surface which lies in a plane generally normal to the longitudinal axis A of the BOP stack 10 and faces towards the second part 60*b* of the support frame.

Between the first and second parts of the support frame 60 is located a seal which in this embodiment of the invention comprises a seal packing element 64, and a seal, in this example comprising a first sealing element 66 and a second sealing element 68. The seal packing element 64 and the sealing elements 66, 68 together form a tube with a generally circular transverse cross-section. The seal packing element 64 forms the radially outermost surface of the tube, the second sealing element 68 forms the radially innermost surface of the tube, with the first sealing element 66 being sandwiched between the two. The length of the seal packing element 64 increases from its radially innermost portion to its radially outermost portion, with the seal elements 66, 68 being just slightly shorter than the radially innermost portion of the seal packing element. The ends of seal packing element 64 thus engage with the inclined face of the adjacent lips of the first and second parts of the support frame, with the seal elements 66, 68 being sandwiched between the edge portions.

A substantially identical seal is provided between the second and third parts of the support frame 60.

Four assembly clamps 62 are provided, to connect the support frame to the seals, a first assembly clamp 62*a* connecting the first part 60*a* of the support frame 60 to the uppermost end of the uppermost seal, a second assembly clamp 62*b* connecting the uppermost end of the second part 60*b* of the support frame 60 to the lowermost end of the uppermost seal, a third assembly clamp 62*c* connecting the lowermost end of the second part 60*b* of the support frame 60 to the uppermost end of the lowermost seal, and a fourth assembly clamp 62*d* connecting the third part 60*c* of the support frame 60 to the lowermost end of the lowermost seal.

In this embodiment of the invention, each assembly clamp 62 is a ring with a C-shaped transverse cross-section. A first portion of the clamp 62 is located in a circumferential groove in the radially outermost face of the respective support frame 60 part whilst a second portion of the clamp 62 is located in a circumferential groove in the radially outermost face of the respective seal packing element 64, the clamp 62 thus spanning the join between the support frame 60 and the seal.

As shown in FIG. 2, the seal assembly 42 is located in the central bore of the BOP stack 10, with the uppermost seal adjacent the packing element 18 of the uppermost BOP 12*a*, and the lowermost seal adjacent the packing element 18 of the middle BOP 12*b*, the first part of the support frame 60 engaging with the first part 14*a* of the housing 14 of the uppermost BOP 12*a*, the second part of the support frame 60 engaging with the first combined housing part 38, and the third part of the support frame 60 engaging with the second combined housing part 40.

When the pistons 20 of the uppermost BOP 12*a* and the middle BOP 12*b* move to the active position, the packing element 18 is compressed around and engages with the radially outermost surface of seal packing element 64. This compresses the seal, and, when a drill string is present in the BOP stack 10, causes each seal to close tight, like a sphincter, around the drill string. When the BOP stack 10 is mounted in a riser as described above, the engagement of the seal with the drill string, the packing elements 18 with the seal, and the packing elements 18 with the housing 14 substantially prevents flow of fluid along the annular space between the BOP housing 14 and the drill string. As such, the riser annulus is closed by the movement of the piston 18 of either of the uppermost BOP 12*a* or middle BOP 12*b* to the active position.

In this embodiment, the seal assembly 42 does not extend into the lowermost BOP 12*c* in the stack 10, so when activated by movement of the pistons 20 as described above, the packing element 18 of the lowermost BOP seals around the drill string without there being an intervening seal. This means that when the seal elements 66, 68 in the seal assembly 42 wear out, the seal assembly 42 can be removed from the BOP stack 10 and replaced with a new seal assembly, whilst the lowermost BOP maintains pressure in the annulus. It should also be noted that the packing element 18 in at least the lowermost BOP 12*c* can be activated to fully close the central bore of the BOP stack 10 without there being a drill string or any other component in the central bore of the BOP stack. The same may be true either of the other two BOPs 12*a*, 12*b*, although in normal use, they would not be required to do this as the sealing assembly 42 is usually in place.

It should be appreciated that a drill string extending through the BOP stack 10 may rotate relative to the BOP stack 10 during drilling, and that there may also be translational movement of the drill string generally parallel to the longitudinal axis A of the BOP stack 10, for example during stripping or tripping operations, or, where the drill string is suspended from a floating drilling rig, due to movement of the drilling rig with the swell of the ocean. When a seal is pushed into engagement with the drill string as described above, this relative movement will cause wear of the seal. The materials from which the seal elements 66, 68 are constructed are selected to reduce wear of the seal and heating effects due to frictional forces between the seal elements 66, 68 and the drill string.

In particular, in one embodiment, the second sealing element 68, which is in contact with the drill string, is a polymeric material selected to provide such properties whilst having the mechanical integrity to provide an effective seal. The polymeric sealing element 68 may be made from polytetrafluoroethylene (PTFE) or a PTFE based polymer. To provide the seal with this necessary resilience to move out of engagement with the drill string when pressure from the packing elements 18 of the adjacent BOP 12*a*, 12*b* is released, there is a further seal element, namely the first seal element 66 which is made from an elastomeric material. The elastomeric sealing element 66 may be made from polyurethane or hydrogenated nitrile butadiene rubber.

Whilst in the elastomeric sealing element 66 and the polymeric sealing element 68 may be fabricated as separate tubes and placed in mechanical engagement with one another, or they may be co-moulded to form a single part. In one embodiment of seal, the polymeric seal 68 includes a plurality of apertures (preferably radially extending apertures), and the elastomeric sealing element 66 is cast or moulded onto the polymeric seal 68 so that the elastomer extends into, and preferably substantially fills these apertures.

In this embodiment of seal assembly 42, the two tubular walls are provided with an array of slots which extend generally parallel to the longitudinal axis A of the BOP stack 10. Hydraulic ports (not shown) are provided through the housing 14 connecting these slots to the exterior of the housing 14, so that, in use, lubricant may be circulated through these ports into the central bore of the seal assembly 42 between the two seals of the seal assembly 42, and between the lowermost seal of the seal assembly 42 and the lowermost packing element 18 of the BOP stack 10. It will be appreciated that, by virtue of the supply of lubricant to these regions, the lubricant may assist in further reducing the frictional forces between the seal elements 66, 68/packing element 18 and the drill string when closed around the drill string.

Movement of the sealing assembly 42 relative to the BOP stack 10 is substantially prevented by means of a plurality of hydraulically actuated locking dogs 56 which are best illustrated in FIGS. 4 and 5. In this embodiment of the invention, two sets of locking dogs 56 are provided—an upper set, which is located in the first part 14*a* of the housing 14 of the uppermost BOP 12*a*, and a lower set, which is located in the second combined housing part 40 between the middle BOP 12*b* and the lowermost BOP 12*c*. It should be appreciated that the locking dogs 56 need not be in exactly those locations. Also in this embodiment of the invention, each set comprises a plurality of locking dogs 56 which are located in an array of apertures around a circumference of the housing as best illustrated in FIG. 3.

In this embodiment of the invention, each locking dog 56 has a non-circular transverse cross-section and is located in a correspondingly shaped aperture in the housing 14 which extends from the exterior of the housing 14 into the central bore of the housing generally perpendicular to the longitudinal axis A of the BOP stack 10. Rotation of the locking dog 56 within the aperture is therefore prevented. Sealing devices 58 are provided in the longitudinal surface of each locking dog 56 to provide a substantially fluid tight seal between the locking dog 56 and the housing 14, whilst permitting the locking dog 56 to slide within the housing 14 generally perpendicular to the longitudinal axis A of the BOP stack 10. In this example, each sealing device 58 comprises an elastomeric ring seal which is located in a groove around the longitudinal surface of the locking dog 56. Also in this example, two sets of two ring seals are provided.

A radially outward end of each locking dog 56 is provided with an actuating stem 60 which extends into a hydraulic connector 62 mounted in the aperture at the exterior surface of the housing 14. Sealing devices are provided between the hydraulic connector 62 and the housing 14 and between the hydraulic connector 62 and the stem 60, so that the hydraulic connector 62 and stem 60 form a piston and cylinder arrangement. The locking dog 56 may therefore be pushed into a locking position in which a radially inward end of the locking dog 56 extends into the central bore of the housing 14 by the supply of pressurised fluid to the hydraulic connector 62.

The RDD 42 is dropped or lowered in the in the uppermost end of the BOP stack 10 with the uppermost set of locking dogs 56 retracted into the housing 14 (as illustrated in FIG. 1) whilst the lowermost set of locking dogs 56 are in the locking position (as illustrated in FIG. 5). The RDD 42 thus comes to rest with its lowermost end in engagement with the lowermost locking dogs 56. Once the RDD 42 is in this position, hydraulic fluid is supplied to the uppermost hydraulic connectors 62 to push the uppermost locking dogs 56 into the locking position in which their radially inward ends extend into the central bore of the housing 14 (as illustrated in FIGS. 2, 4 and 5). The RDD 42 is positioned such that when the locking dogs 56 are in the locking position it lies between the two sets of locking dogs 56, and an end of the RDD 42 engages with each of the locking dogs 56. By virtue of this, longitudinal movement of the RDD 42 in the BOP stack 10 is prevented, or at least significantly restricted.

Although not essential, in this example, the radially inward end of each locking dog 56 is provided with a shoulder 56*a* which engages with an end of the RDD 42.

By virtue of using locking dogs which can be retracted into the housing 14 wall, it will be appreciated that the mechanical locking of the RDD 42 does not impact on the diameter of the central bore of the BOP stack. Moreover, by retracting the locking dogs 56 into the housing 14 wall, the accumulation of debris on these features when no sealing assembly is present, can be avoided.

Instead of a sealing assembly 42, the locking dogs 56 described above can be used to retain a different tubular component in the central bore of the BOP stack 10. Such an alternative to the sealing assembly 42 could be a snubbing adaptor with a rotating control device (RCD) mechanism at the uppermost end thereof. In this case, to retain the component in the BOP stack 10 when subjected to pressure from below, the uppermost locking dogs 56 may engage with a shoulder or groove provided in the radially outermost surface of the component, rather than the uppermost end of the component. This allows an RCD mechanism or the like mounted on the tubular component to be located at the very uppermost end of the BOP stack 10, or even to extend out of the BOP stack 10 into the upper riser portion 48.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A blow out preventer comprising:

a housing having a longitudinal axis and being divided into a first housing part and a second housing part;

a plurality of fasteners, movement of the first housing part relative to the second housing part being prevented by the plurality of fasteners, each fastener including a shaft which extends through a fastener receiving passage provided in the first housing part into a fastener receiving passage provided in the second housing part;

fluid flow passages extending within the housing in a longitudinal direction from the first housing part of the housing to the second housing part of the housing, the fluid flow passages being interspersed between fastener receiving passages in a circumferential direction; and an annular packing element and an actuating part which is movable generally parallel to the longitudinal axis of the blow out preventer to push the packing element into engagement with the first part of the housing, compression of the packing element against the first part of the housing causing the diameter of the space enclosed by the packing element to decrease.

2. The blow out preventer of claim 1 wherein the outer diameter of the blow-out preventer is less than 47 inches (119.4 cm).

3. The blow out preventer of claim 1 wherein the fluid flow passages and the fastener receiving passages are arranged in a generally circular array.

4. The blow out preventer of claim 3 wherein the circular array is centred around the longitudinal axis of the blow out preventer.

5. The blow out preventer of claim 1 wherein there are two or more fastener receiving passages between each adjacent pair of fluid flow passages.

6. The blow out preventer of claim 1 wherein the fasteners comprise a shaft which, in use, extends into one of the fastener receiving passages, at least a portion of which is threaded, and at least a portion of the fastener receiving passage in one or both of the first of second part of the housing is provided with a correspondingly threaded portion so that, in use, the threaded portion of the shaft of each fastener is engaged with the threaded portion of fastener receiving passage.

7. The blow out preventer of claim 1 wherein the fastener receiving passages extend from a shoulder in the exterior surface of the housing which joins a smaller outer diameter portion of housing with a larger outer diameter portion of housing, into the housing.

8. The blow out preventer of claim 7 wherein the shoulder extends generally perpendicular to the longitudinal axis of the blow out preventer.

9. The blow out preventer of claim 7 wherein the fasteners are each provided with a head at one end of the shaft, when in use, the head engaging with the shoulder.

10. The blow out preventer of claim 1 wherein the fastener receiving passages and the fluid flow passages extend generally parallel to the longitudinal axis of the blow out preventer.

11. The blow out preventer of claim 1 wherein a sealing device is provided between the first part of the housing and the second part of the housing.

12. The blow out preventer of claim 11 wherein the sealing device engages with the interior surface of both the first part of the housing and the second part of the housing.

13. The blow out preventer of claim 1 wherein the internal diameter of the first part of the housing increases from a first port to a second port so that the interior face of the first part of the housing forms a cam surface with which the packing element engages when compressed by the actuating part.

14. The blow out preventer of claim 1 further including a fluid pressure actuated locking part which is provided in an aperture extending from the exterior of the housing to the interior of the housing, and which is movable from a retracted position in which the locking part does not extend into the interior of the housing to a locking position in which the locking part extends into the interior of the housing.

15. A blow out preventer stack comprising a plurality of blow out preventers in accordance with claim 1, the blow out preventers being arranged such that the longitudinal axis of each lies on a single line.

16. The blow out preventer stack according to claim 15 wherein the first part of the housing of a first blow out preventer is integrally formed with the second part of the housing of a second blow out preventer.

17. The blow out preventer stack according to claim 16 wherein the exterior of the housing is provided with a shoulder which joins the smaller diameter portion of the first part of the housing of the first blow out preventer with the second part of the housing of the second blow out preventer, the second part having a smaller external diameter than the first part.

18. The blow out preventer stack according to claim 17 wherein at least one of the fluid flow passages in the housing of the first blow out preventer may be connected to a fluid flow passage in the housing of the second blow out preventer via a pipe at least a portion of which is external to the housing.

19. The blow out preventer stack according to claim 18 wherein the pipe extends from a shoulder between the second part of the housing of the second blow out preventer and a smaller outer diameter portion of the first part of the housing of the first blow out preventer and a shoulder between the smaller outer diameter portion and a larger outer diameter portion of the first part of the housing of the first blow out preventer.

20. The blow out preventer of claim 1 wherein a joining portion of the first housing part and the second housing part via the plurality of fasteners has an outer diameter, and the plurality of fasteners and the fluid flow passages are arranged radially inward of the outer diameter toward the longitudinal axis of the housing.

21. A blow out preventer comprising a housing, and a first and second fluid pressure actuated locking parts, each of which is provided in an aperture extending from the exterior of the housing to the interior of the housing, and movable from a retracted position in which the locking part does not extend into the interior of the housing to a locking position in which the locking part extends into the interior of the housing, wherein the first and second fluid pressure operated locking parts are separated longitudinally relative to the housing, the first locking part when in its locking position, engaging with a tubular component in a manner that a lowermost end of the tubular component is resting on top of the first locking part, to prevent or restrict translational movement of the tubular component in a first direction along the central passage of the blow out preventer housing, and the second locking part, when in its locking position, engaging with the tubular component in a manner that an uppermost end of the tubular component is below the second locking part, to prevent or restrict translational movement of the tubular component in a second direction along the central passage of the blow out preventer housing.

22. The blow out preventer according to claim 21 wherein two fluid pressure operated locking parts are provided, the two fluid pressure operated locking parts being separated longitudinally relative to the housing.

23. A blow out preventer assembly including the blow out preventer of claim 21 and the tubular component which is located in a central passage of the blow out preventer housing, the locking part when in its locking position, engaging with the tubular component to prevent or restrict translational movement of the tubular component along the central passage of the blow out preventer housing.

24. A method of supporting a tubular component in a blowout preventer, the method comprising the steps of:

providing a blowout preventer according to claim 21;

moving the second locking part to the retracted position;

moving the first locking part to the locked position;

dropping the tubular component into the housing so that the lowermost end of the tubular component rests on top of the first locking part; and after the step of dropping, moving the second locking part to the locking position so that the uppermost end of the tubular component is below the second locking part and bears against an lower surface of the second locking part, whereby a translational movement of the tubular component in the housing is restricted.

25. A blow out preventer comprising:

a housing having a longitudinal axis and being divided into a first housing part and a second housing part;

a plurality of fasteners, movement of the first housing part relative to the second housing part being prevented by the plurality of fasteners, each fastener including a shaft which extends through a fastener receiving passage provided in the first housing part into a fastener receiving passage provided in the second housing part; and fluid flow passages extending within the housing in a longitudinal direction from the first housing part of the housing to the second housing part of the housing, the fluid flow passages being interspersed between fastener receiving passages in a circumferential direction, wherein, the fastener receiving passages extend from a shoulder in the exterior surface of the housing which joins a smaller outer diameter portion of housing with a larger outer diameter portion of housing, into the housing, and the fasteners are each provided with a head at one end of the shaft, when in use, the head engaging with the shoulder.

26. The blow out preventer of claim 25 wherein the fasteners comprise a shaft which, in use, extends into one of the fastener receiving passages, at least a portion of which is threaded, and at least a portion of the fastener receiving passage in one or both of the first of second part of the housing is provided with a correspondingly threaded portion so that, in use, the threaded portion of the shaft of each fastener is engaged with the threaded portion of fastener receiving passage.

27. The blow out preventer of claim 25 wherein the shoulder extends generally perpendicular to the longitudinal axis of the blow out preventer.

28. A blow out preventer stack comprising a plurality of blow out preventers, the blow out preventers being arranged such that the longitudinal axis of each lies on a single line, wherein each blow out preventer comprises:

a housing having a longitudinal axis and being divided into a first housing part and a second housing part;

a plurality of fasteners, movement of the first housing part relative to the second housing part being prevented by the plurality of fasteners, each fastener including a shaft which extends through a fastener receiving passage provided in the first housing part into a fastener receiving passage provided in the second housing part; and fluid flow passages extending within the housing in a longitudinal direction from the first housing part of the housing to the second housing part of the housing, the fluid flow passages being interspersed between fastener receiving passages in a circumferential direction.

29. The blow out preventer stack according to claim 28 wherein the first part of the housing of a first blow out preventer is integrally formed with the second part of the housing of a second blow out preventer.

30. The blow out preventer stack according to claim 29 wherein the exterior of the housing is provided with a shoulder which joins the smaller diameter portion of the first part of the housing of the first blow out preventer with the second part of the housing of the second blow out preventer, the second part having a smaller external diameter than the first part.

31. The blow out preventer stack according to claim 30 wherein at least one of the fluid flow passages in the housing of the first blow out preventer may be connected to a fluid flow passage in the housing of the second blow out preventer via a pipe at least a portion of which is external to the housing.

32. The blow out preventer stack according to claim 31 wherein the pipe extends from a shoulder between the second part of the housing of the second blow out preventer and a smaller outer diameter portion of the first part of the housing of the first blow out preventer and a shoulder between the smaller outer diameter portion and a larger outer diameter portion of the first part of the housing of the first blow out preventer.

* * * * *